US006925846B2

(12) United States Patent
Perruccio

(10) Patent No.: US 6,925,846 B2
(45) Date of Patent: Aug. 9, 2005

(54) PORTABLE MINI-BREAK

(76) Inventor: Daniel Perruccio, 91 Copeland St., Springfield, MA (US) 01108

( * ) Notice: Subject to any disclaimer, the term of this patent is extended or adjusted under 35 U.S.C. 154(b) by 0 days.

(21) Appl. No.: 10/429,113

(22) Filed: May 1, 2003

(65) Prior Publication Data

US 2004/0079131 A1 Apr. 29, 2004

Related U.S. Application Data

(60) Provisional application No. 60/376,525, filed on May 1, 2002.

(51) Int. Cl.[7] ..... B21D 5/04

(52) U.S. Cl. ..... 72/319; 72/461

(58) Field of Search ..... 72/319–321, 461, 72/388; 225/96.5

(56) References Cited

U.S. PATENT DOCUMENTS

| | | | | | |
|---|---|---|---|---|---|
| 143,558 | A | * | 10/1873 | Brand | 72/320 |
| 155,060 | A | * | 9/1874 | Bacon | 72/319 |
| 312,547 | A | * | 2/1885 | Andersen | 72/319 |
| 480,396 | A | * | 8/1892 | Clark | 72/31.11 |
| 520,262 | A | * | 5/1894 | Geissinger | 72/320 |
| 1,097,874 | A | * | 5/1914 | Philippi | 72/319 |
| 1,124,963 | A | * | 1/1915 | Sievert | 72/321 |
| 1,619,537 | A | * | 3/1927 | Parrish | 72/321 |
| 2,166,347 | A | * | 7/1939 | Farney | 72/458 |
| 2,905,224 | A | * | 9/1959 | Allison | 72/31.12 |
| 3,248,921 | A | * | 5/1966 | Trout | 72/319 |
| 3,267,713 | A | * | 8/1966 | Johnson et al. | 72/297 |

FOREIGN PATENT DOCUMENTS

| | | | | |
|---|---|---|---|---|
| FR | 630479 | * | 12/1927 | 72/319 |
| GB | 177471 | * | 3/1922 | 72/319 |

* cited by examiner

*Primary Examiner*—Daniel C. Crane

(57) ABSTRACT

A sheet metal bending tool for bending materials, such as flat metal sheets is disclosed. The tool has a restraining base for receiving and cooperatively holding a sheet metal workpiece and the tool has a bending component that is rotatably mounted to the restraining base, the workpiece is held, cooperating with the restraining base component, and the clamp bar for stabilizing the workpiece while the workpiece is held and bent by the rotating action of the bending component. In the preferred embodiment, the workpiece is restrained by a template comprising a pattern of holes drilled, a hole receiving a peg or means of stop, the stops (pegs) constraining the workpiece from movement while being bent act like a jig for measuring and predetermined incumbents. Holes are also drilled in restraining base and in the bending component at spaced intervals along lines that are run parallel to the line defined by the intersection of the bending component and the restraining base. There is a pull back bar that is used for the process of cutting. The Unit can be clamped down also. Rulers are installed on the clamp bar, and the slide table. The apparatus is designed so that two or more may be joined together to form a larger apparatus for the purpose of bending larger workpieces.

2 Claims, 17 Drawing Sheets

PORTABLE MINI-BREAK

RELATED APPLICATIONS

This application is related to and derives priority from U.S. Provisional Application No. 60/376,525, entitled PORTABLE MINI-BREAK, filed May 1, 2002, which is incorporated herein by reference.

BACKGROUND

1. Field of the Invention

This invention relates to metal-forming and shaping tools, and more particularly to manually operable metal-bending devices of the type especially adapted to impart any of a number of predetermined shapes to metal stock, or other materials.

2. Current Art

In the past, numbers of tools for performing a variety of bending operations on metal stock have been proposed and produced, and have met with varying degrees of success.

However, and examination of these devices reveals several limitations of these tools; they are complex to use, expensive to make, bulky and non-portable.

SUMMARY

With the aforementioned limitations in mind, it is a general object of the invention to provide a tool for bending sheet metal, and which is simple to use and can be operated by one person.

It is a further object of the invention to provide a tool for bending sheet metal which is small and portable and which may be used at a variety of work locations.

It is yet a further object of the invention to provide a tool for bending metal and other materials and which is inexpensive to manufacture, easy to use and requires minimal skill to operate.

Another object of the invention is a tool for bending materials, whereby the tool may be coupled or combined with another similar tool to create a larger tool for bending materials of larger sizes.

And yet another object of the invention is to provide a tool for bending metal that is furnished with a template to facilitate the bending of sheet metal to a variety of angles and shapes.

A sheet metal bending tool is disclosed. The tool includes a restraining base for receiving and cooperatively holding a sheet metal workpiece. The tool has a bending component optionally having a second base, the bending component rotatably mounted by a hinge to the restraining base, the bending component also holding the workpiece in cooperation with the restraining base. And the tool has a stabilizing component for stabilizing the workpiece while the tool bends the workpiece. The workpiece held by the restraining base and the second base is bent by the rotating action of the bending component.

In the preferred embodiment, the workpiece is restrained in a desired position by at least one peg received by a hole drilled in the restraining base or by a hole drilled in the base of the bending component. Holes are drilled in the tool according to two drilling patterns: (1) holes are drilled in successive rows, each row aligned with the hinge mounting the bending component to the restraining base; and (2) holes are drilled according to a pattern, called a template, the template in the restraining base. Pegs are placed in the holes to hold the workpiece so that a certain desired bending angle can be made in the workpiece. Template holes are also drilled at a variety of angles relative to the mounting interface, so that the workpiece can be bent at a variety of angles. It will be obvious to those reading this disclosure that the pegs may be held in the drilled holes by friction alone, or both pegs and holes may be furnished with threads to permit the pegs to be screwed into the holes.

The tool is designed so that two or more tools can be combined to form a larger tool, which is capable of accepting and bending workpieces of larger sizes. In forming a larger tool, two or more tools are joined together, end to end. The restraining base of one tool is placed and fixed end-to-end with the restraining base of the second tool, and the base of the bending component of the first tool placed and fixed end-to-end with the base of the bending component of the second apparatus so that a larger tool surface is formed for receiving and holding larger workpieces.

DETAILED DESCRIPTION

Figure 1A:
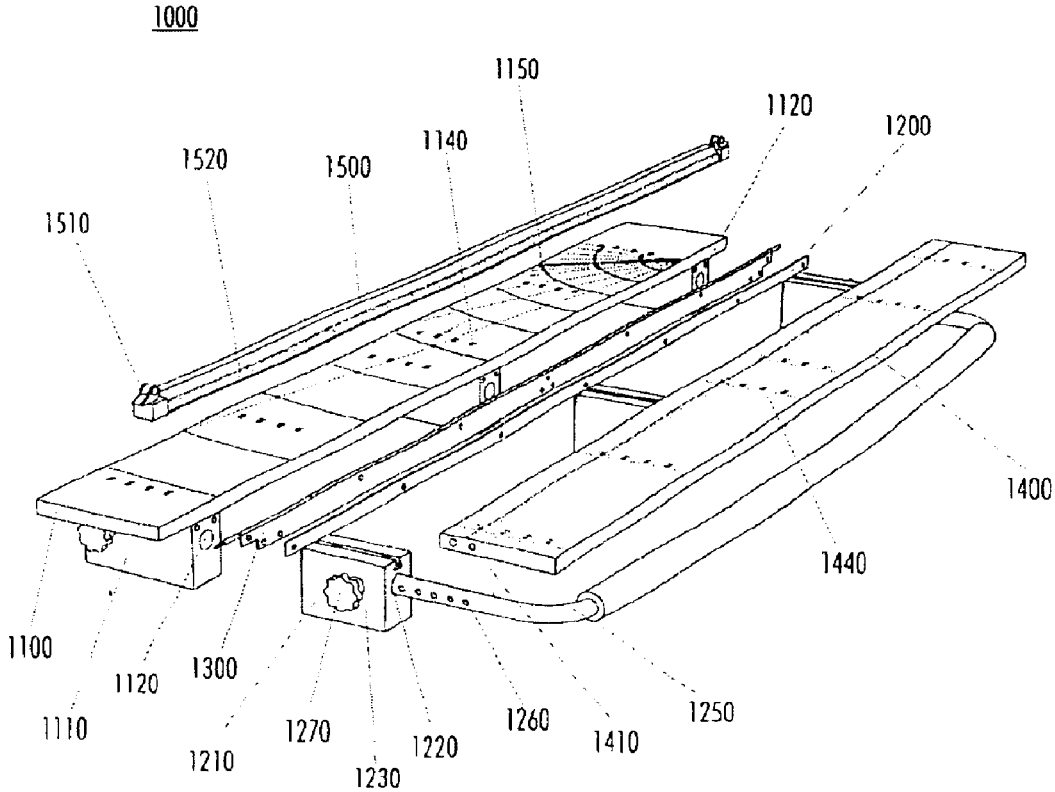
FIG. 1A shows the basic arrangement of structural components of the apparatus comprising the restraining base 1100, the bending component 1200 and the clamp arm 1500, Also the second base called the Slide table 1400. The restraining base and Slide table have holes drilled and fitted with pins or pegs or stops for restraining a workpiece.

With respect to FIG. 1A, the metal bending tool 1000 comprises a restraining base 1100 for placing and cooperatively holding a sheet metal workpiece; a bending component 1200 optionally receiving and fixing in position a second base 1400, the bending component rotatably mounted by a hinge 1300 to the restraining base 1100, the bending component and, optionally, the second base 1400 cooperatively holding the metal workpiece in conjunction with the restraining base 1100. The restraining base 1100 is adapted to receive a clamp arm 1500 for holding and stabilizing the workpiece while the workpiece is bent by the rotating action of the bending component 1200.

The bending component 1200 has a handle 1250 that is used by an operator to bend a metal workpiece. The handle 1250 is received by a hole 1220 drilled through each handle block 1210 of the bending component 1200. Each hole 1220 is drilled completely through the handle block 1210 so that the ends of the handle 1250 may be inserted partially into or all the way through the handle block 1210. The handle 1250 has a plurality of holes 1280 the first hole with pin 1270 inserted is in operational use. The second hole 1280 with pin 1270 inserted places the tool 1000 in the in-operative position or the carrying position. Each handle block 1210 has a second hole 1260 for attaching the second base 1400 (the slide table) onto the bending component 1200. The pin for holes 1260 goes to the holes on the slide arm 1410

The restraining base 1100 has a plurality of mounting blocks 1110, each mounting block having a hole 1120 drilled therein. The size and placement of the mounting blocks 1110 are such that when the handle 1250 of the bending component 1200 is down each handle block 1210 aligns with a respective mounting block 1110. When the mounting blocks 1110 are aligned with the handle blocks 1210, the handle 1250 is inserted completely through the holes 1220 in the handle blocks 1210 and into the holes 1120 in the mounting block and locked into place by inserting the pin 1270 through the aligned holes 1280 on the Lifting Handle 1250. In this manner the tool can be locked and easily transported.

While the bending operation is being performed, the apparatus 1000 can be mounted to a workbench or can be attached to legs or a stand. For that purpose mounting block 1110 is provided as part of the apparatus 1000. It can be seen from the drawing that when the bending component 1200 and the second base called the Slide table 1400 are in a down position (the plane defined by the handle is parallel to the plane defined by the base of the restraining component 1100), the handle block 1210 is contiguous and aligned with the mounting block 1110. FIG. 1A shows the arrangement of the handle block 1210 and the mounting block 1110 when the bending component 1200 and second base 1400 is in the down position.

The tool is used by: (1) positioning the bending component such that the tops of the handle blocks and the surface of the restraining base lie in a plane; (2) placing a workpiece on the surfaces of both the restraining base 1100 and the lifting bar of the bending component 1200, and the top surface of the second base 1400 if it has been mounted in the tool, and (3) restraining the workpiece to lie flat in a fixed position on both surfaces, which are initially aligned by the hinge 1300 in a common flat plane. After the workpiece is constrained to the surface of the restraining base 1100 and the (4) the clamp bar 1500 is operated to hold the workpiece to the surfaces, by fastening the clamp bar 1500 down against the workpiece, the clamp bar 1500 attached to the restraining base 1100 by a mounting attachment 1510 on the clamp bar 1500. (5) The bending component 1200 is operated so the second base 1400 is rotated upward. When the bending component 1200 is so operated the two surfaces no longer occupy a common plane, but now occupy two planes intersecting at an angle, the two planes intersecting along the line defined by the hinge 1300, which is parallel to the line made by the contact of the clamp bar 1500 with the workpiece. Since the workpiece is simultaneously constrained by the clamp bar 1500 to the plane of the surfaces of the restraining base 1100 and to the plane of the second base 1400, the workpiece is bent along the line made by the clamp bar 1500 contacting the workpiece, which is a line parallel to the hinge 1300, and the lifting bar 1200

The bases of the bending component, restraining component and stabilizing components are preferably constructed from metal or from plastic or wood that is laminated with metal surfaces.

One example of the use of the second base occurs when a rectangular workpiece is bent according to an angle other than parallel to the edge of the workpiece. In this case the workpiece will require constraints provided by pegs placed in holes drilled in the second base.

Figure 1B:
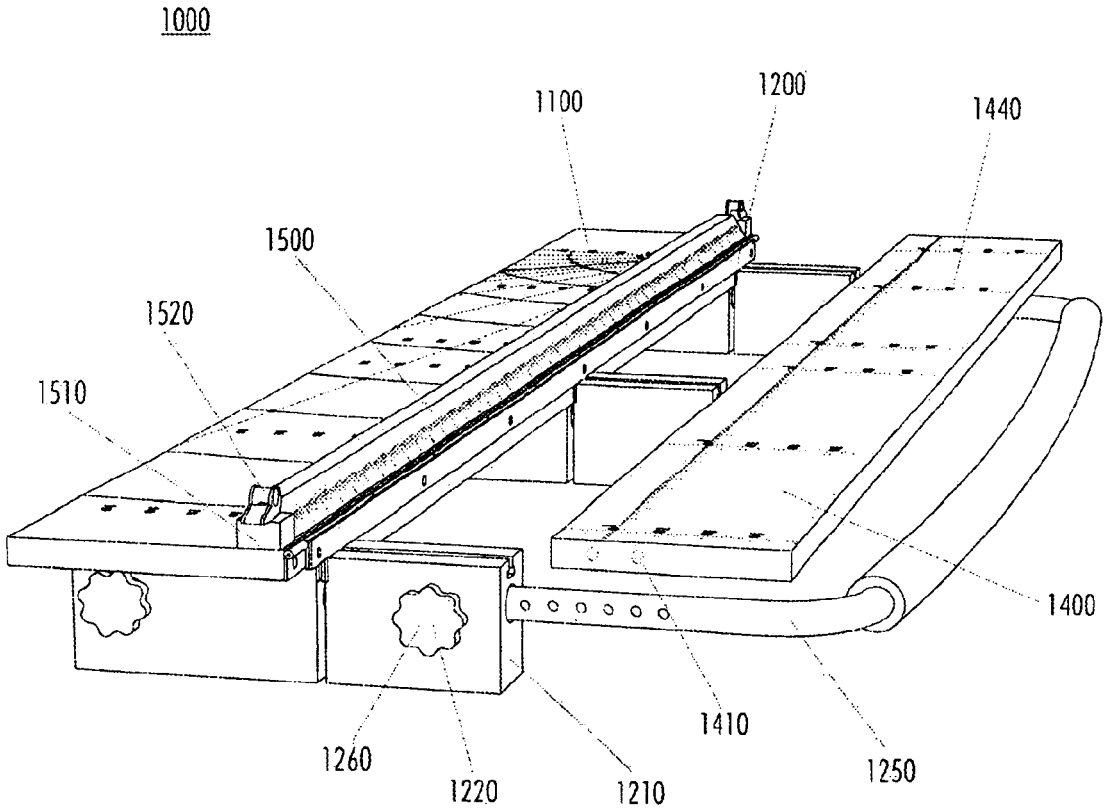
FIG. 1B shows the apparatus assembled and ready to accept a workpiece for bending or cutting.

With reference to FIG. 1B the tool 1000 is shown in an assembled form ready to receive and bend a workpiece. The restraining base 1100 is rotatably attached by the (hidden) hinge to the bending component 1200. The handle 1250 is received and held fixed in the first hole 1220 of the handle block 1210 by the handle pin 1270. The second base 1400 is optionally received by and held between the handle blocks 1210 by the base pin inserted into the handle block hole 1260, the pin passing into a hole 1410 in the second base.

With reference to FIG. 1B the clamp bar 1500 is shown locked down by the cam handle 1520 having a pin or screw passing through the mounting attachment 1510 to immovably fix the clamp bar 1500 to the restraining base 1100. It will be appreciated that in this locked position, a workpiece will be held and pressed down against the surfaces of the restraining base and the top of the bending component the Lifting Bar 1200. If more surface area is required to support the workpiece, the second base 1400 may be inserted between, pinned and held by the handle blocks 1210.

Figure 1C:
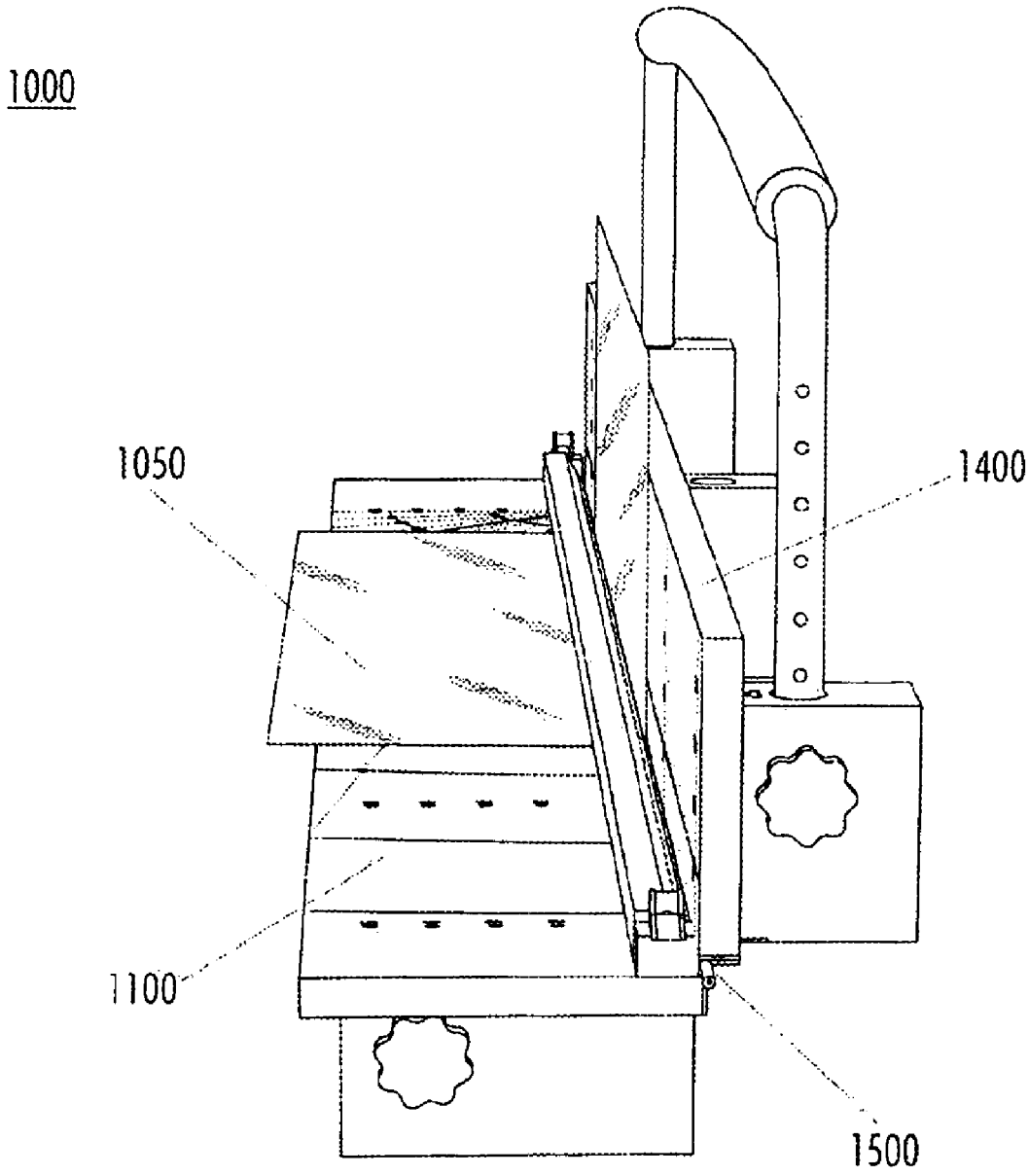
FIG. 1C depicts the apparatus as it appears after bending or cutting a workpiece.

With reference to FIG. 1C the apparatus 1000 is shown in a position as it appears after a workpiece 1050 is bent. The workpiece is held flat to the surfaces of the restraining base 1100 also to the Slide table 1400 and the bending component 1200.

Detailed Description of Operating the Metal Bending Tool

Figure 2A:
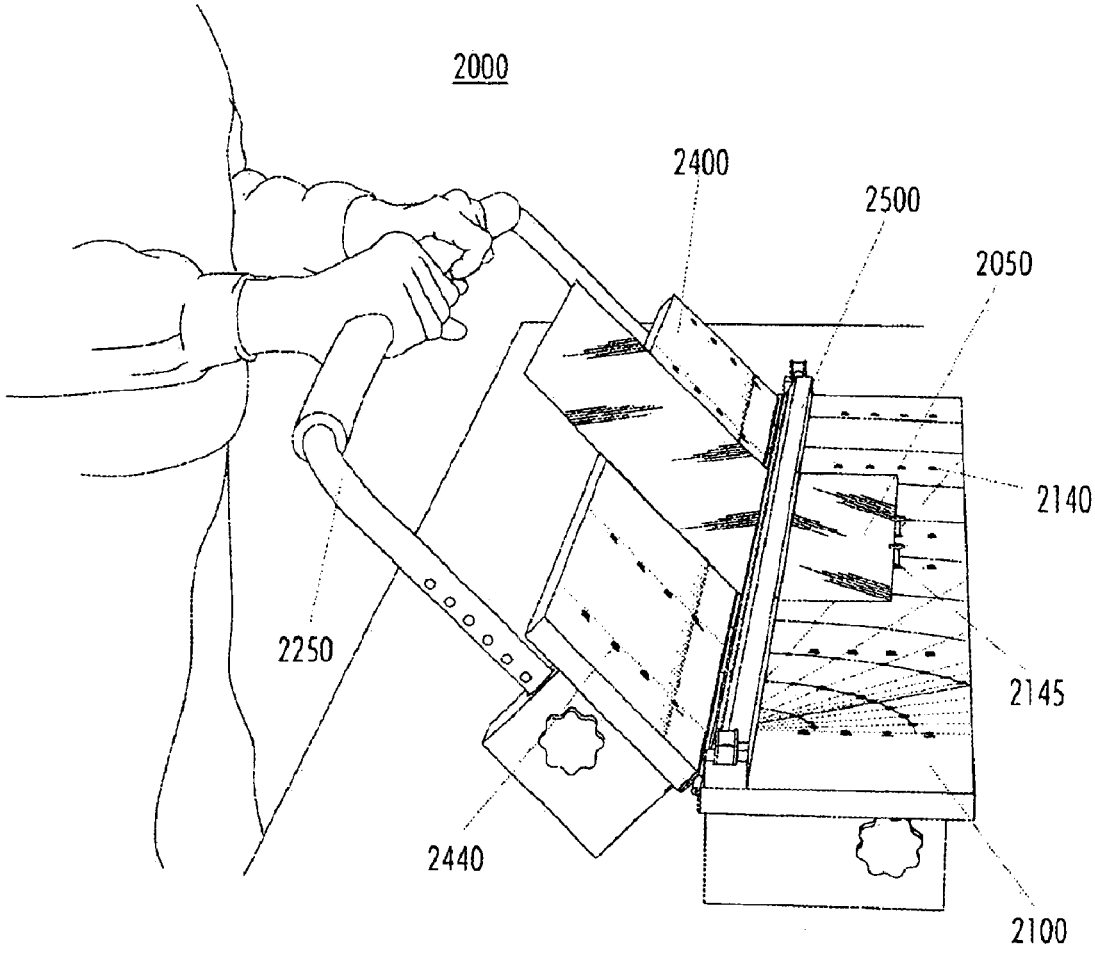
FIG. 2A shows the application of the apparatus to bend a flat metal workpiece, and in which the relative positions of the structural components and other components are shown while a flat metal workpiece is bent.

With respect to FIG. 2A, the tool 2000 is operated by a person who places a metal workpiece 2050 on the flat surfaces of both the base of the bending component which could consist of the Lifting Bar 1200 FIG. 1A and the other base the restraining base 2100; the tops of both surfaces lying in a single plane when the tool is ready to receive a workpiece. If more surface area is required of the bending component, the second base 2400 the slide bar can be inserted between the handle blocks of the bending component, and fixed by a pin or some other fastening means.

Both the slide table 2400 and the restraining base 2100 have a plurality of holes 2140, 2440, each of which receive pegs or stops 2145 and 2445 for holding the workpiece 2050 in place while being bent. As previously described, holes are drilled according to two patterns, which are described in more detail below. It will be appreciated that by placing pegs in holes drilled into the bases of the bending component 2400 or the restraining component 2100, that the workpiece will be prevented from slipping or sliding on the surface and therefore marring the fidelity or angle of the bend to be performed by the operator.

The workpiece is held flat against the surfaces of the bending component base 2400 and the restraining component 2100 by the clamp arm 2500. The workpiece can be cut or bent at this point. To cut, a sharp edge is run along the face of the clamp arm 2500. The lifting component 2200 has the slide table 2400 secured to its bases. On the slide table ends a pull back bar 2600 is connected at slots 2601. This parallel action snaps the material at the mar.

Figure 2B:
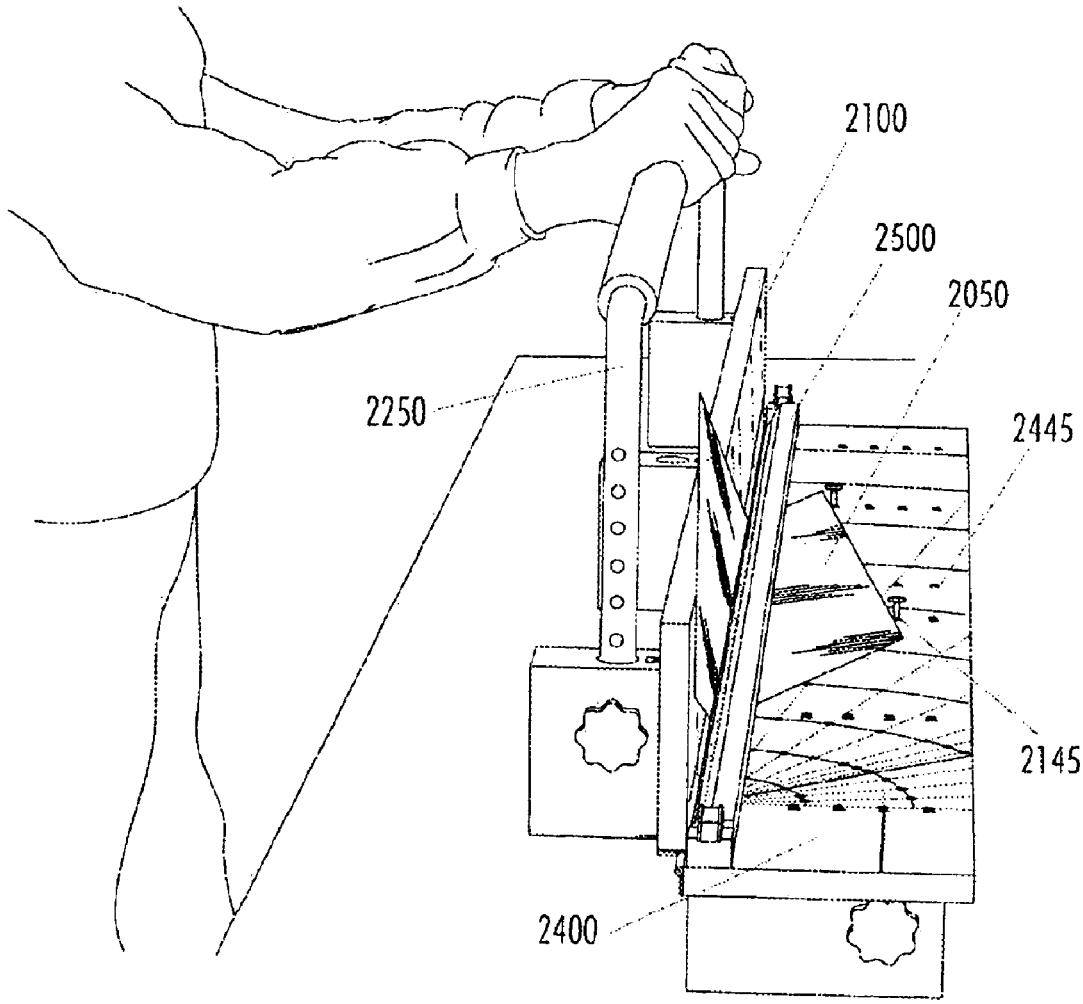
FIG. 2B shows the application of the apparatus to bend a flat workpiece, and in which the relative positions of the restraining base, bending component and clamp arm are shown after a flat metal workpiece is bent.

With reference to FIG. 2B the operator of the apparatus pulls up on the handle 2250, causing the bending component 2200 to rotate into the base of the restraining component 2100. Since the workpiece 2050 is constrained by pins or pegs 2145 in the base of the restraining component 2100, and by the clamp arm 2500, the workpiece 2050 is bent by the action of the operator.

The bend is performed by the operator first grasping a handle 2250 attached to the handle block of the bending component 2200, then pulling upward to cause the bending component 2200 to rotate with respect to the restraining base 2100. The workpiece is held to the surfaces of the bending component 2200 and the restraining base 2100 by a clamp arm 2500. By the combined restraining force exerted on the workpiece by the retraining base and the bending component and by the additional constraining action of the clamp arm 2500, and in response to the force applied by the operator causing the bending component 2200 to rotate, the metal workpiece is bent upward. It can be seen from FIG. 2B, that the downward force of the clamp arm 2500, in reaction to the upward rotational force applied by the operator to the bending component, causes the workpiece to be bent upward along a line defined by the geometry or shape of the clamp arm 2500.

It will be appreciated that the clamp arm 2500 contacts the workpiece along a sharp, straight line; and as a result of the geometry of contact the clamp arm causes the workpiece to be bent along a well defined and sharp or narrow line defined by the geometry or shape of the clamp arm. The stops or pegs act like jigs that are drilled holes in parts 2100 and 2400.

By reference to FIG. 2B, it can be seen that the workpiece 2050 can be bent at almost any desired angle up to approximately 120 degrees, then removed from the tool by lifting the workpiece 2050 from the surfaces of the bending component 2200 and the restraining base 2100 after loosening or removing the clamp arm 2500.

Figure 3A:
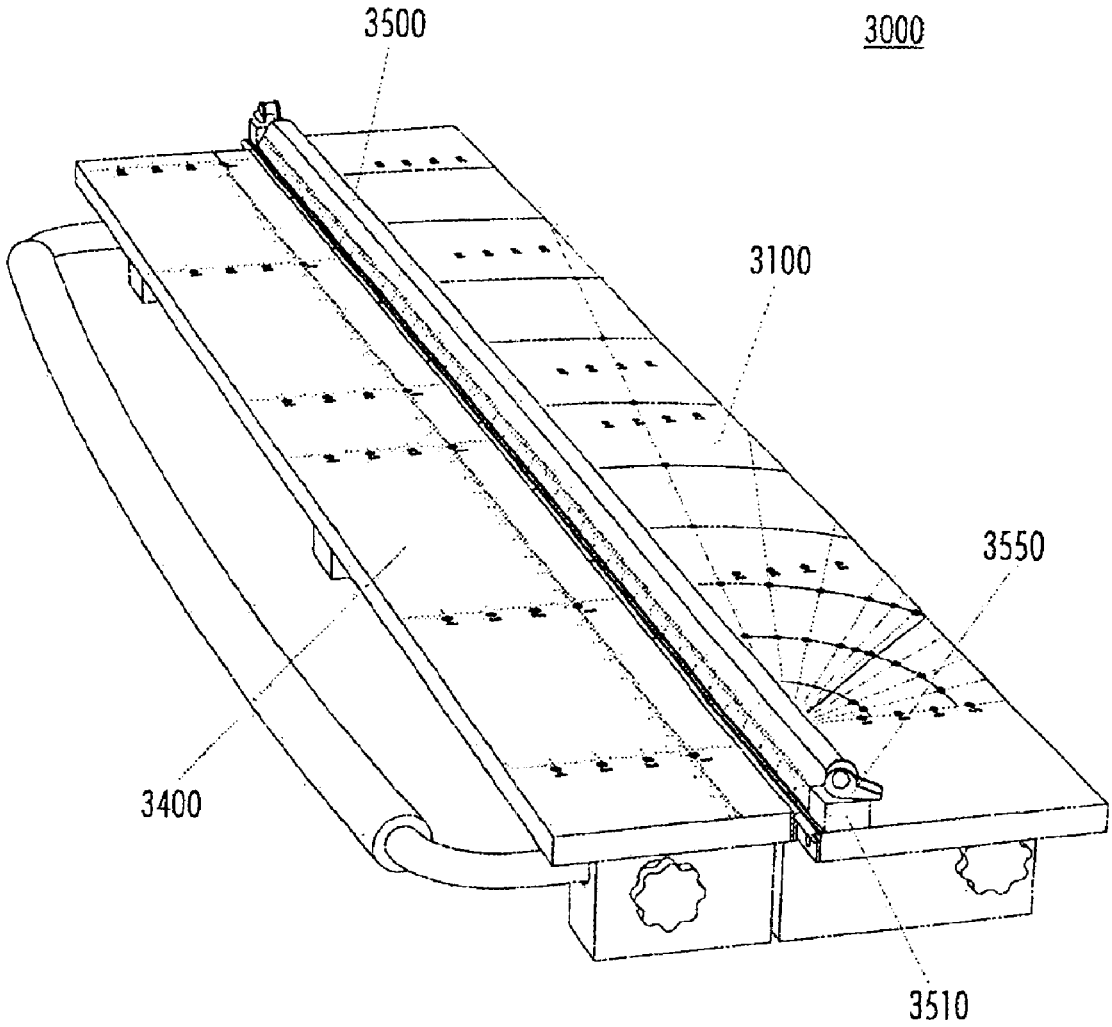
FIG. 3A shows the clamp arm of the apparatus in relationship to other components of the apparatus.
Figure 3B:
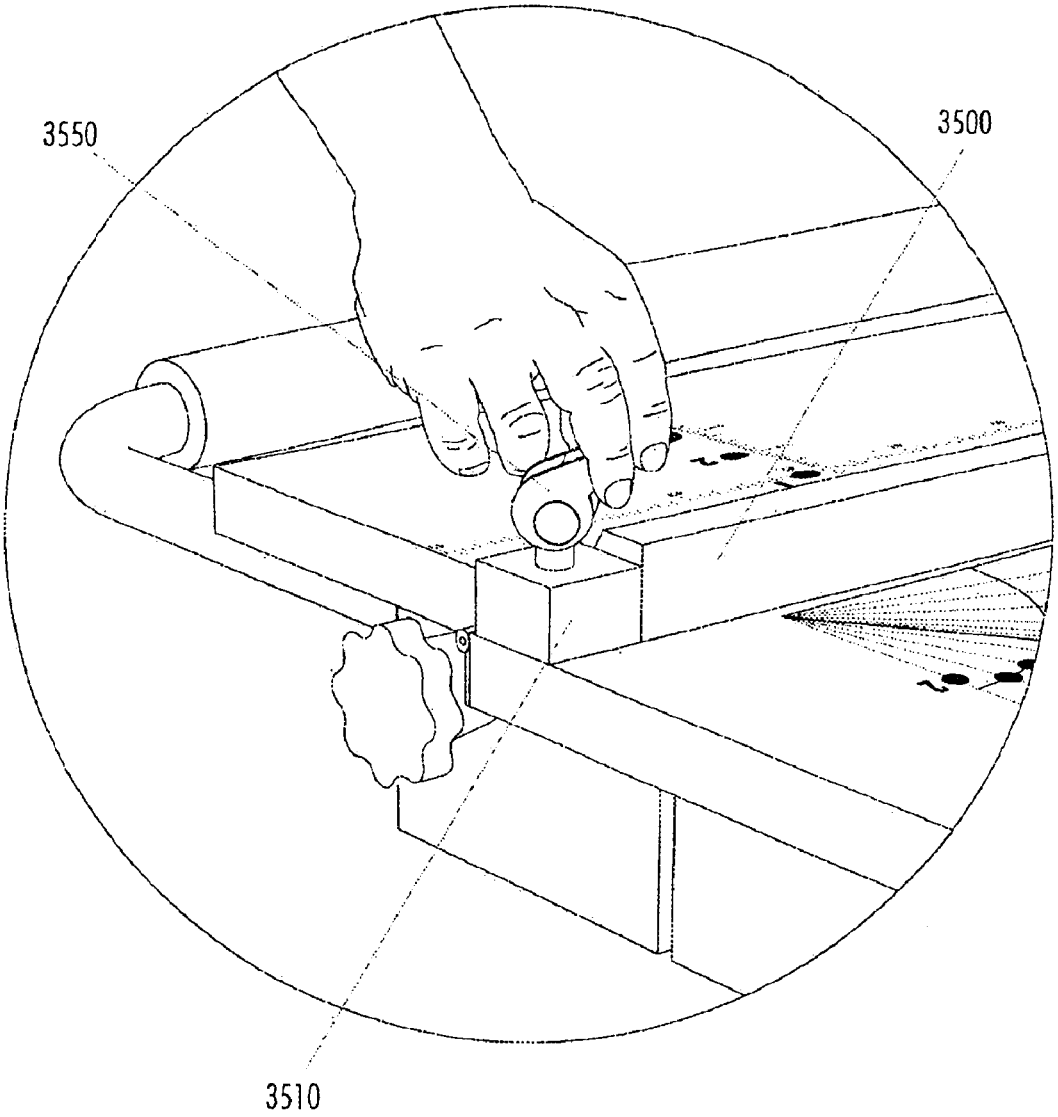
FIG. 3B shows application of the cam handle used to clamp and hold a workpiece for bending.
Figure 3C:
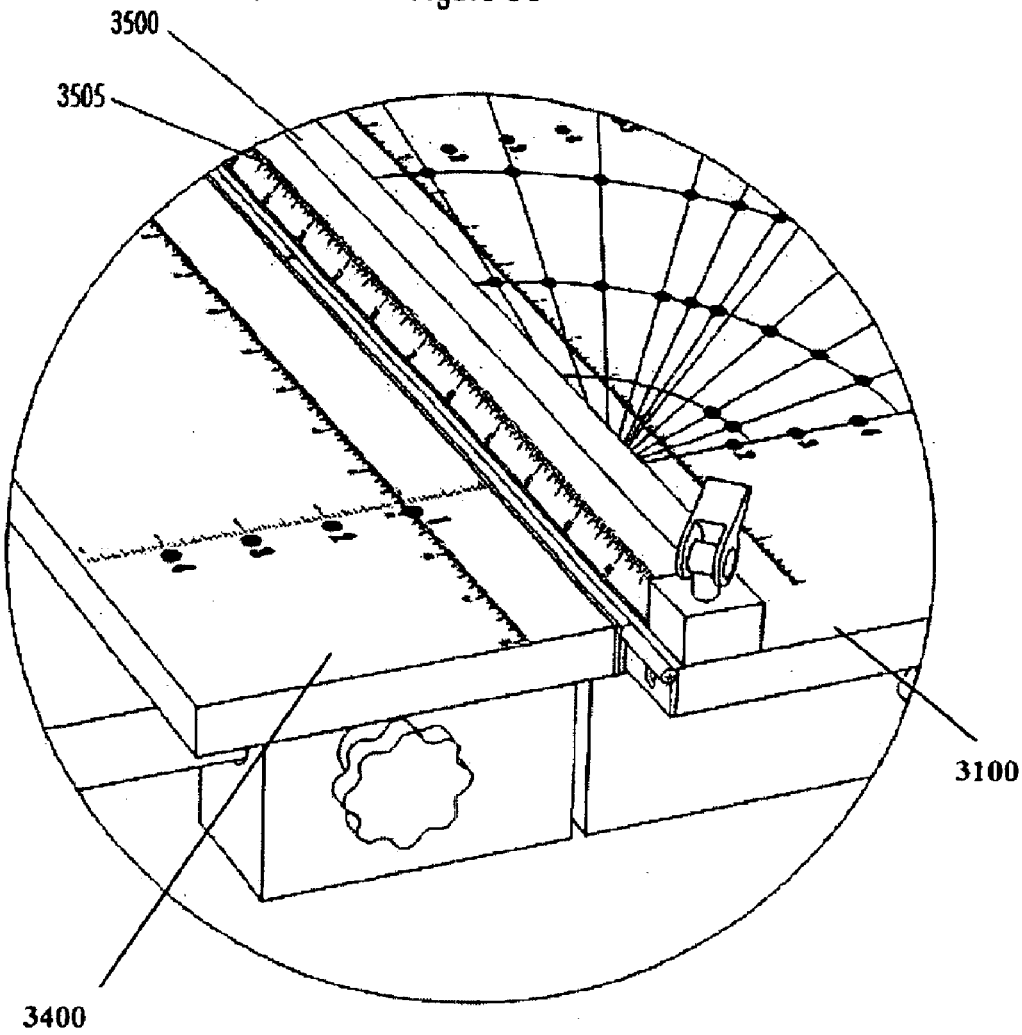
FIG. 3C shows the tapered edge of the clamp arm.

An examination of FIG. 3C shows the clamp arm 3500 to have a tapering base 3505 that creates a knife-like edge that runs parallel to the edge of the restraining base 3100. The knife-like edge of the tapered base 3505 of the clamp arm 3500 engages the workpiece as it is bent upward by the rotational movement of the bending component 3400, and because of the geometry of the contact with the workpiece, causes a precise and sharp line of bending.

With reference to FIG. 3A, the apparatus 3000 is shown with more detail regarding the positional relationships among the restraining base 3100, the bending component 3200, the slide table 3400 and the clamp arm 3500. The clamp arm 3500 is attached by a fastening means 3550 to the base of the restraining base 3100.

The manner and position of attaching is such that the an edge of the clamp arm 3500 runs parallel and flush with the edge of the restraining base 3100. In this position, the knife-like edge of the clamp arm 3500 will engage the workpiece as the workpiece is forced upward by the rotational motion of the bending component 3400.

Again with reference to FIG. 3A the clamp arm has a portion thereof 3510 that accepts a fastening device for the purpose of holding the clamp arm 3500 against the surface of the restraining base 3100, and at the same time by immovably holding a workpiece flat against the restraining base 3100.

In an exemplary arrangement, a pin having a cam handle 3550 is passed through the clamp arm at 3510, and is attached to the restraining base 3100. The pin with cam handle is made with threads, which are accepted by a properly threaded hole in the restraining base 3100. The pin with cam handle 3550 is screwed into the threaded hole in the restraining base 3100 at both ends of the clamp arm 3500.

With reference to FIG. 3B after a workpiece is passed under the clamp arm 3500 and laid flat on the apparatus, the cam handle 3550 is lifted up and due to the action of the cam the clamp arm 3500 is forced downward to cause the workpiece to be held tight against the surface of the bending tool.

Figure 4A:
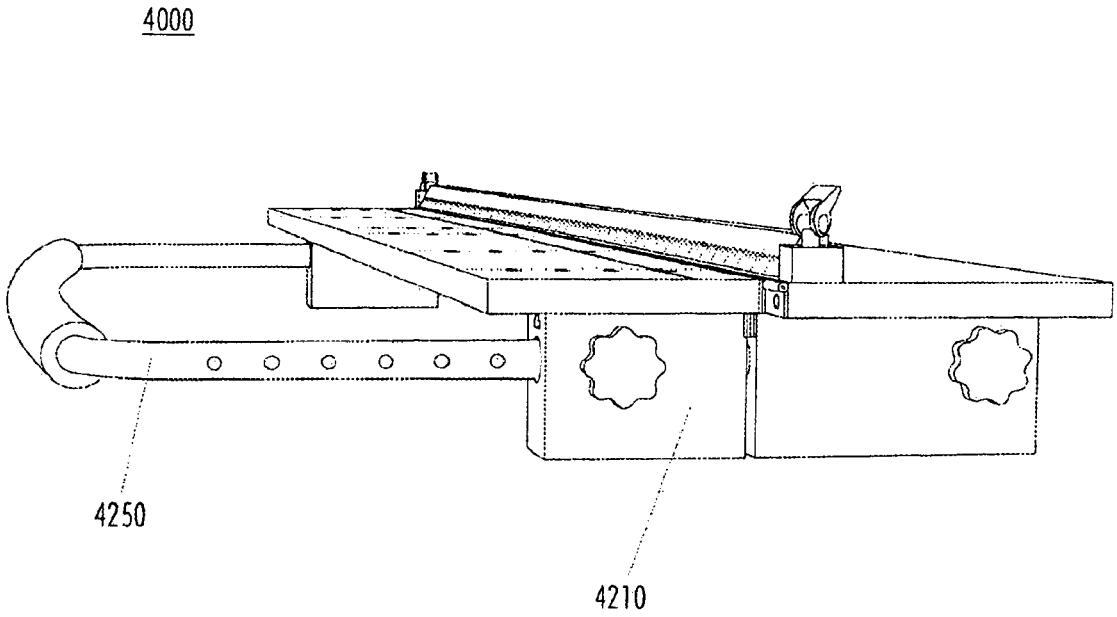
FIG. 4A shows the handle of the apparatus withdrawn, making the apparatus ready for use.

With reference to FIG. 4A, the tool 4000 is shown with the handle 4250 withdrawn from the handle blocks 4210, whereby the tool is ready for use.

Figure 4B:
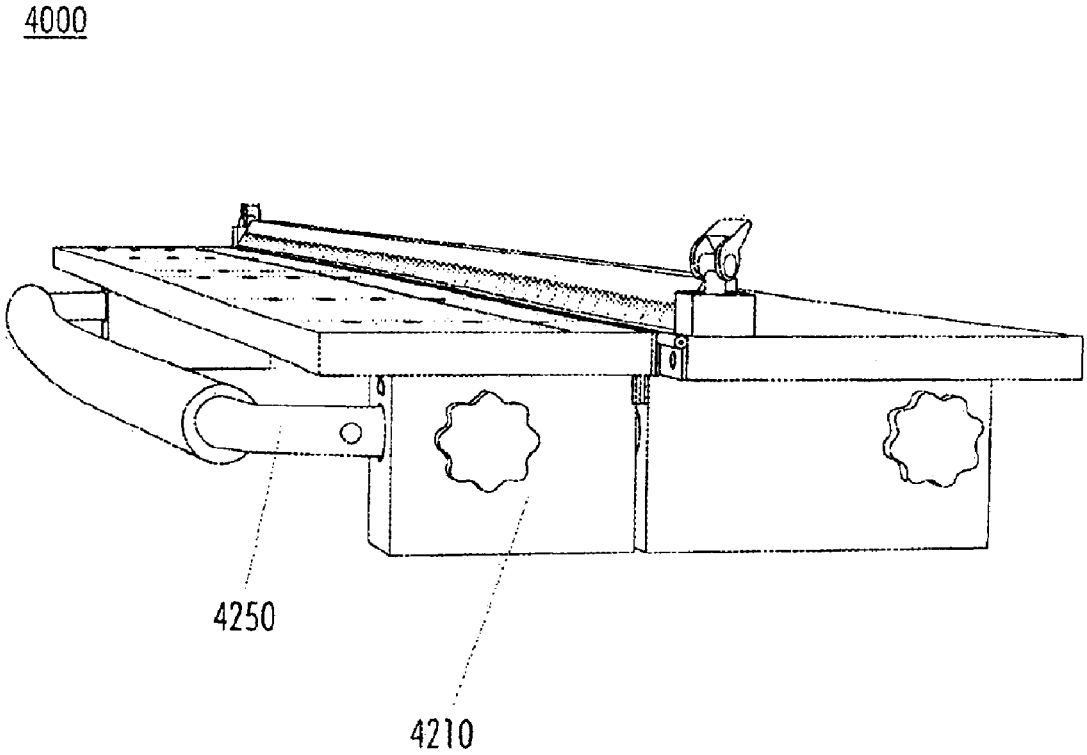
FIG. 4B is an illustration of the handle fully inserted into the apparatus, locking the components together.

With reference to FIG. 4B the tool is shown with the handle 4250 inserted into the handle blocks 4210, and further into the mounting blocks 1110 of the restraining base 1100 as shown in FIG. 1A. When the handle 4250 is inserted into the mounting blocks of the restraining base, the handle can be fixed in this position by a pin or peg that passes through a hole drilled in the handle block 4210, the hole aligned with a similar hole in the handle 4250.

Figure 4C:
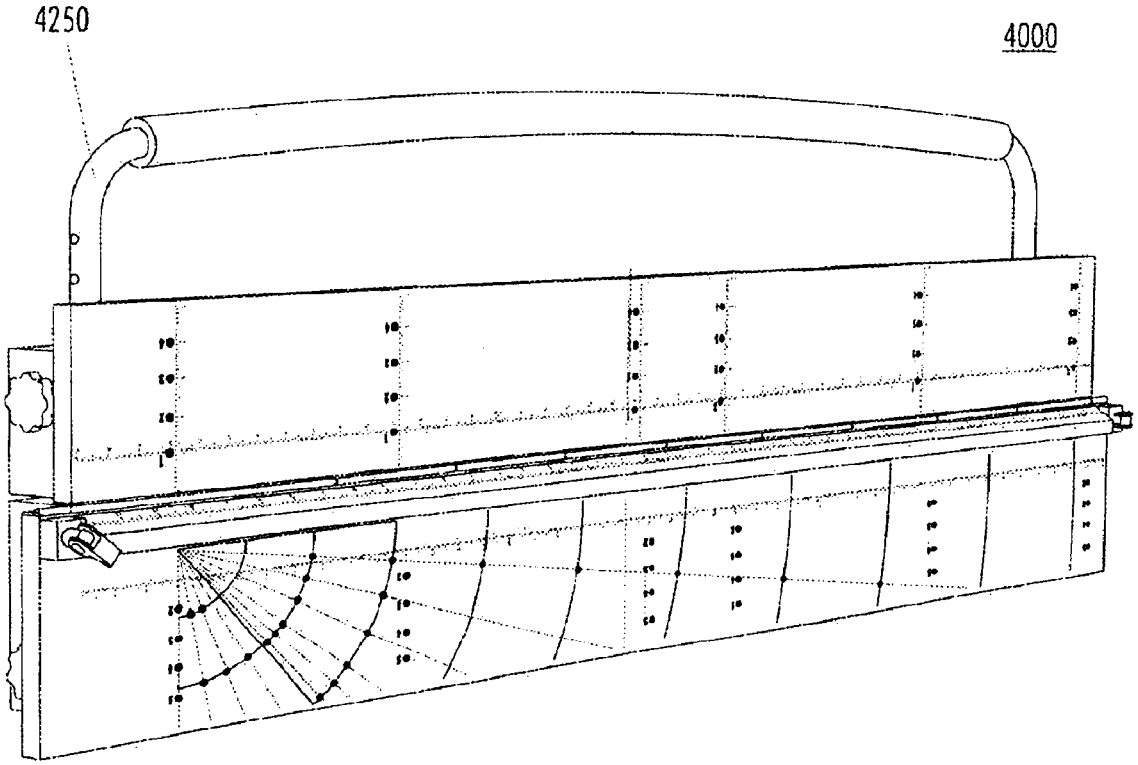
FIG. 4C shows the apparatus with components locked together, the apparatus ready for transport.

With reference to FIG. 4C, the tool is shown with the handle 4250 inserted and held by a peg or pin. In this arrangement, the tool can be carried about or transported.

Patterns of Holes and Pegs to Hold the Workpiece

A workpiece is held in the tool by placing the workpiece on the surface of the tool, then placing pegs in the appropriate holes. If complex bending angles are required the template is used. Complex bending angles comprise the set of angles that are not parallel or perpendicular to an edge of the workpiece.

Tool Template

Figure 5A:
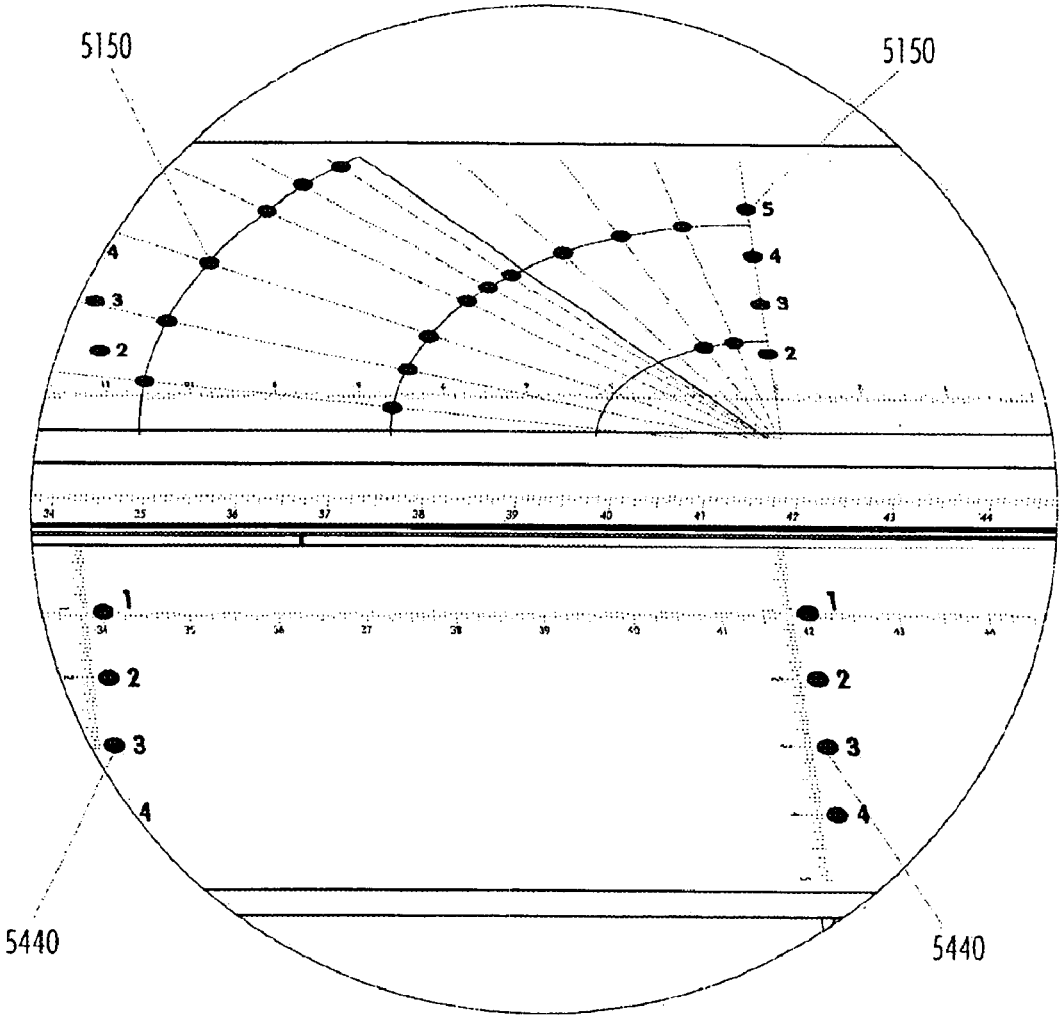
FIG. 5A illustrates the arrangements of holes drilled in the apparatus, the holes receiving pegs or pins for restraining a workpiece, the holes drilled in a first pattern for orthogonal bending or cutting and the holes drilled according to the requirements for non-orthogonal cutting or bending patterns.

With reference to FIG. 5A the template has holes 5140 made in the restraining base 5100; the template 5140 having a pattern of holes drilled in the form of a protractor, the protractor for the purpose of positioning a workpiece so that a bend can be made that is not parallel to workpiece edge pinned on the restraining base 5100.

It will be appreciated that several arrangements of holes in the template 5140 can be made to provide a variety of bending angles ranging from 20° to 90° in increments of 5°, 10°, for example. It will also be appreciated that the template 5140 can be formed separately and inserted into or fastened to the surface of the bending component or the surface of the restraining component using any well-known fastening or holding means. FIG. 5A also displays the working storage position 5160 where the stops are placed when not in use. The carrying storage position for the stops is under the slide table placed in the bending component 1200 FIG. 1A.

Figure 5B:
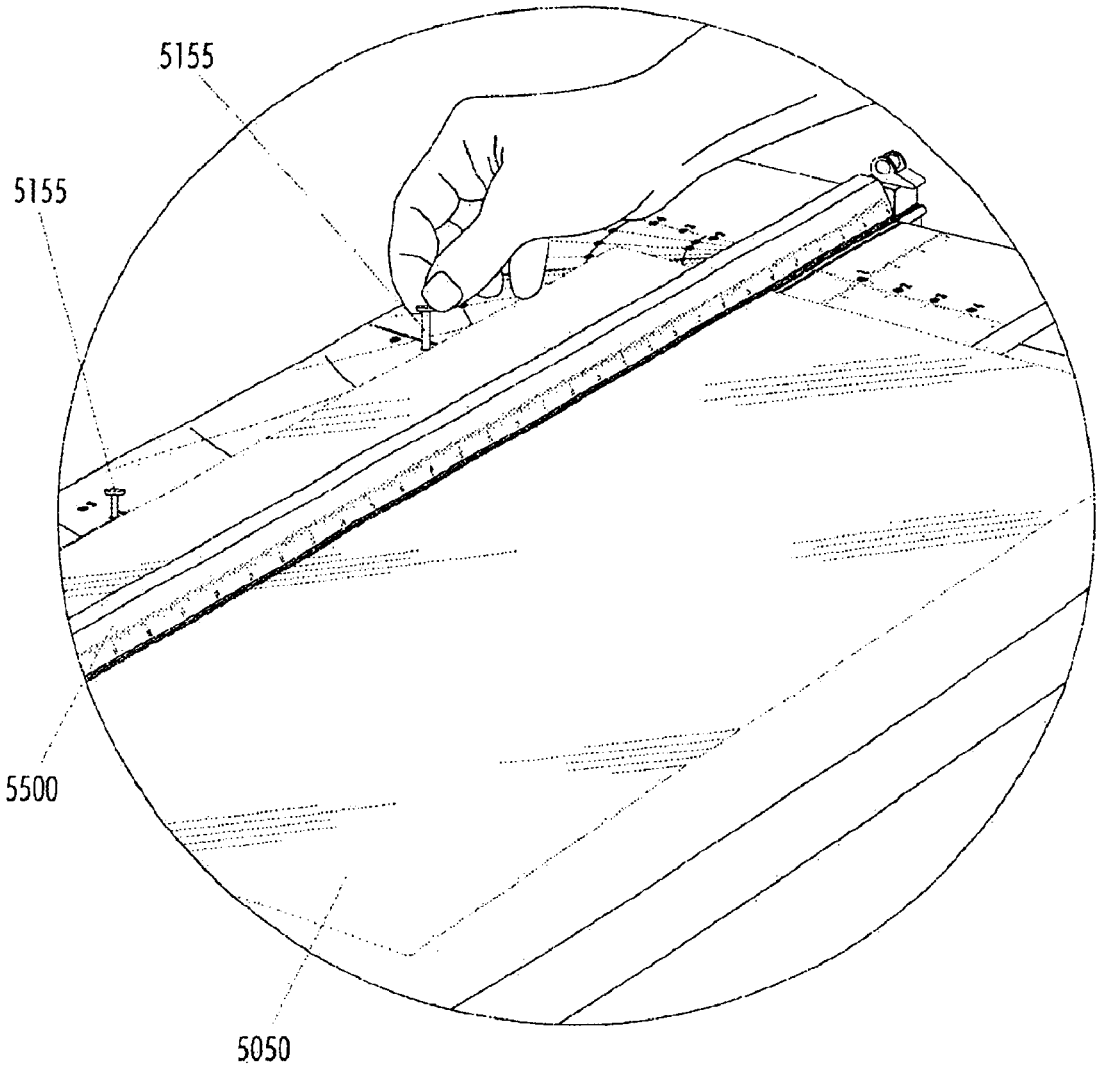
FIG. 5B is a view of an exemplary arrangement of holes to receive pegs for restraining a workpiece, the pegs places so that the bending angle is an angle orthogonal to a workpiece edge.

With reference to FIG. 5B, the tool is shown with a workpiece 5050 that has been passed under the clamp arm 5500. The workpiece 5050 is shown flush against two pegs 5145 that have been placed in holes of the template. In this case, the holes have been selected so that the bend (along the knife edge of the clamp arm 5500) will be orthogonal to edges of the workpiece 5050. While in this position, the cam handle will be operated to clamp the workpiece 5050 down against the surface of the tool so that the desire bend can be made.

Figure 5C:
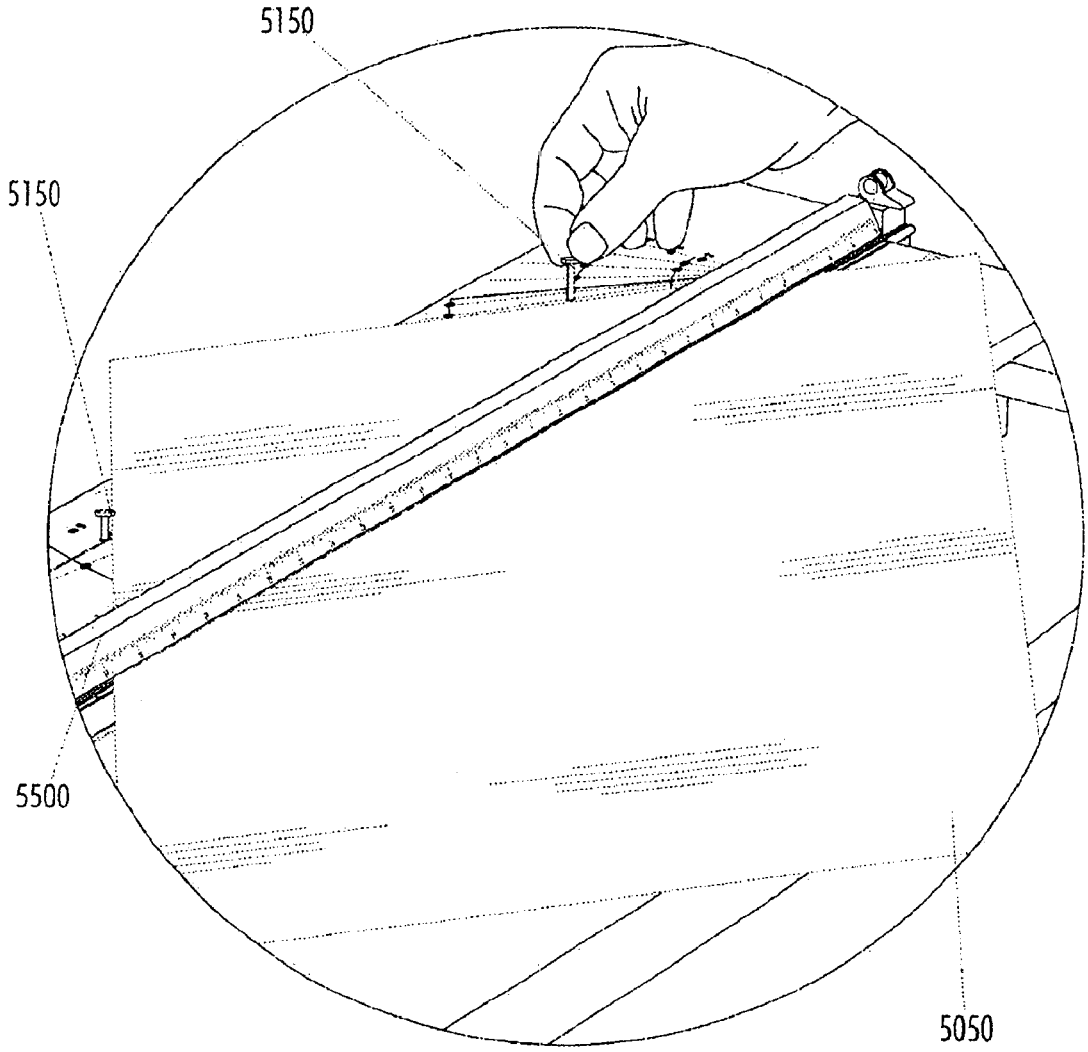
FIG. 5C is a view of an exemplary arrangement of holes to receive pegs for restraining a workpiece, the pegs places so that the bending angle is an angle not orthogonal to a workpiece edge.

With reference to FIG. 5C, the pegs 5150 have set into holes along the lines of the template protractor so that a non-orthogonal bend can be made.

It will be appreciated that from the description given, the tool can be easily and economically made, and can be operated by a single person. The apparatus is compact and, therefore, can be easily transported from place to place.

Using the Tool to Cut a Workpiece

Figure 6A:
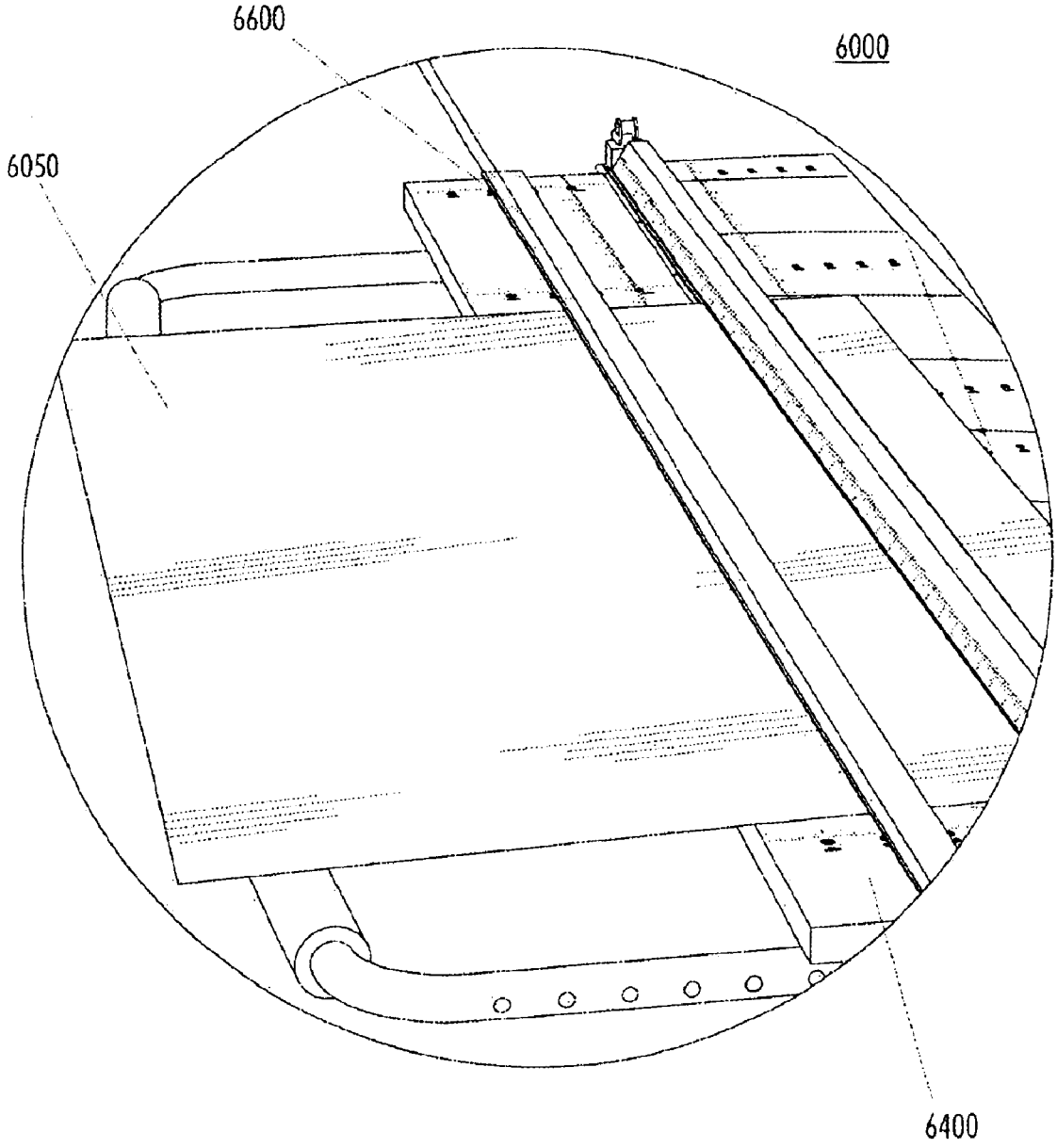
FIG. 6A shows a pullback bar installed on the apparatus, the pullback bar used to cut a workpiece.
Figure 6B:
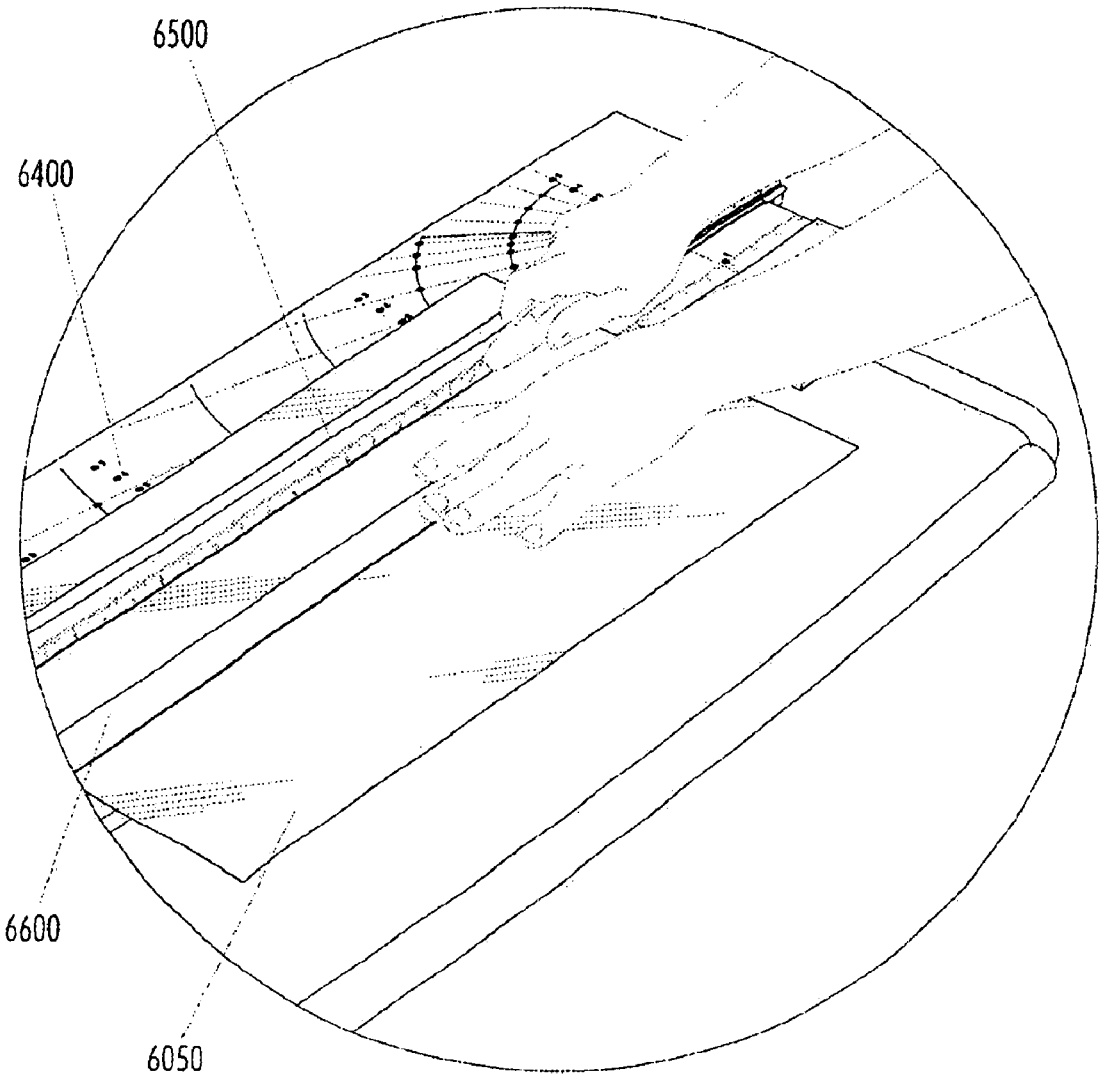
FIG. 6B shows the workpiece being scored prior to cutting by use of the pullback bar.
Figure 6C:
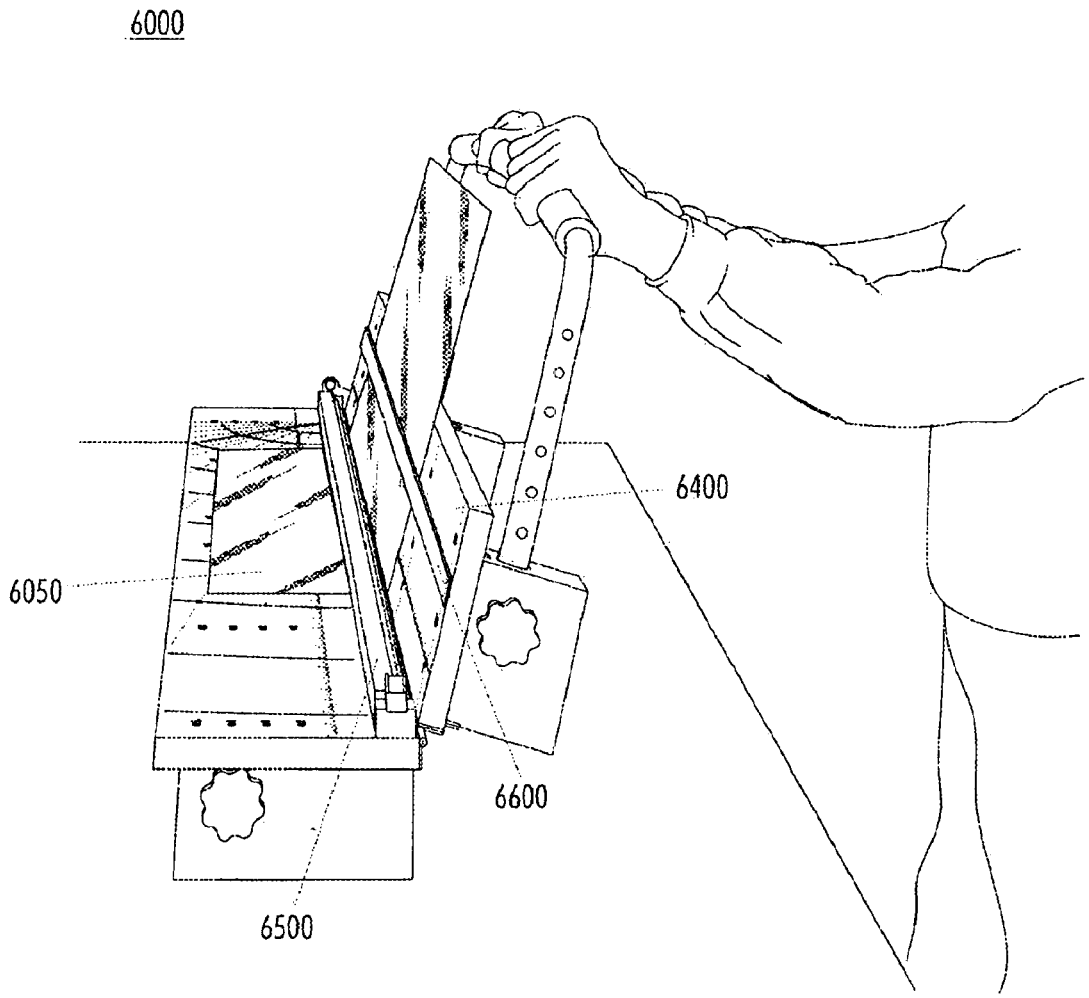
FIG. 6C shows the use of the pullback bar to cut the workpiece.

With reference to FIGS. 6A, 6B and 6C the tool is shown equipped with a pullback bar 6600.

With reference to FIG. 6A the pullback bar 6600 is removably attached to the bending component 6400, whereby a workpiece 6050 is placed under the pullback bar 6600, and is then prepared for bending as previously described.

With reference to FIG. 6B, the workpiece 6050 is scored with a sharp or pointed instrument.

With reference to FIG. 6C, the bending component 6400 is operated by moving the bending component 6400 up and down repeatedly. It can be seen that the pullback bar 6600 causes the workpiece 6050 to be constrained to the surface of the bending component 6400 during the repeated up and down motion. It will be appreciated that after several iterations of up and down bending, the workpiece 6050 will separate cleanly, in a cut, along the line scored.

SUMMARY OF THE DISCLOSURE

The tool has been described and depicted through drawings with typical components and arrangements. It will be appreciated that other variations in component size, capacity and arrangement are possible and will be obvious in view of the preceding disclosure.

Therefore the scope and limitation of the present invention are most suitably provided though and by the following claims.

I claim:

1. A tool for bending sheet metal comprising a restraining base, the top surface of the restraining base for receiving and cooperatively holding a sheet metal workpiece, the workpiece restrained from lateral movement on the surface of the restraining base by a first plurality of pegs received by a first plurality of holes made in the restraining base;

a bending component rotatably attached to the restraining base, the top surface of the bending component for receiving and cooperatively holding the metal workpiece in conjunction with the restraining base wherein the bending component has a second base, the second base having a second plurality of holes, the second base receiving and cooperatively holding the sheet metal workpiece in conjunction with the bending component, whereby the workpiece is prevented from moving on the surface of the second base by a second plurality of pegs received by the second plurality of holes;

a clamp arm for stabilizing and holding the workpiece against the surface of the restraining base and the bending component, the clamp arm having an edge, the edge held against the workpiece by the clamp arm while the workpiece is bent by the rotating action of the bending component;

whereby the workpiece is bent along the clamp arm edge when the bending component is rotated.

2. The metal bending tool of claim 1, wherein the first plurality of pegs are set in holes made in the base, the pegs defining a non-zero angle with respect to the clamp arm edge, whereby the workpiece is bent at a non-zero angle with respect to the workpiece edge.

* * * * *